US008106638B2

(12) United States Patent
Huang

(10) Patent No.: US 8,106,638 B2
(45) Date of Patent: Jan. 31, 2012

(54) POWER CONTROL CIRCUIT WITH COUPLING CIRCUIT FOR CONTROLLING OUTPUT POWER SEQUENCE AND LIQUID CRYSTAL DISPLAY USING SAME

(75) Inventor: Shun-Ming Huang, Shenzhen (CN)

(73) Assignees: Innocom Technology (Shenzhen) Co., Ltd., Shenzhen, Guangdong Province (CN); Chimel Innolux Corporation, Miao-Li County (TW)

( * ) Notice: Subject to any disclaimer, the term of this patent is extended or adjusted under 35 U.S.C. 154(b) by 826 days.

(21) Appl. No.: 12/214,174

(22) Filed: Jun. 16, 2008

(65) Prior Publication Data

US 2008/0309306 A1 Dec. 18, 2008

(30) Foreign Application Priority Data

Jun. 15, 2007 (CN) ..... 2007 1 0075049

(51) Int. Cl.
*G05F 1/577* (2006.01)
*G05F 1/00* (2006.01)

(52) U.S. Cl. ..... 323/267; 323/266

(58) Field of Classification Search ..... 323/272, 323/266–269; 363/59–61
See application file for complete search history.

(56) References Cited

U.S. PATENT DOCUMENTS

| | | | | |
|---|---|---|---|---|
| 4,189,670 | A * | 2/1980 | Tanahashi | 323/267 |
| 5,336,985 | A * | 8/1994 | McKenzie | 323/266 |
| 6,028,419 | A * | 2/2000 | Mack | 323/272 |
| 6,903,734 | B2 | 6/2005 | Eu | |
| 7,116,012 | B2 * | 10/2006 | Kajouke et al. | 307/64 |
| 2002/0135338 | A1 * | 9/2002 | Hobrecht et al. | 323/272 |
| 2003/0214274 | A1 * | 11/2003 | Lethellier | 323/272 |
| 2004/0095104 | A1 * | 5/2004 | Brooks | 323/272 |
| 2005/0099165 | A1 * | 5/2005 | Tani | 323/267 |
| 2005/0179630 | A1 | 8/2005 | Huang | |
| 2006/0119283 | A1 * | 6/2006 | Hur et al. | 315/219 |
| 2009/0273327 | A1 * | 11/2009 | Ito et al. | 323/284 |
| 2010/0052631 | A1 * | 3/2010 | Wu et al. | 323/266 |

FOREIGN PATENT DOCUMENTS

| | | | |
|---|---|---|---|
| CN | 1301428 | C | 2/2007 |
| TW | 200723200 | A | 6/2007 |

* cited by examiner

*Primary Examiner* — Jeffrey Sterrett
*Assistant Examiner* — Gary Nash
(74) *Attorney, Agent, or Firm* — Altis Law Group, Inc.

(57) ABSTRACT

An exemplary power control circuit (24) includes a scaler circuit (245) configured for outputting a control signal, a voltage converter (27) configured for converting a received voltage into a plurality of desired voltages, a first control unit (28), a second control unit (29), and a coupling circuit (26). The first control unit is configured for controlling whether a first voltage is applied to the voltage converter. The second control unit is configured for controlling whether to transmit a second voltage applied thereto. The coupling circuit is between the first and second control units. The coupling circuit enables the second control unit to function ahead of the voltage converter according to the control signal.

20 Claims, 2 Drawing Sheets

POWER CONTROL CIRCUIT WITH COUPLING CIRCUIT FOR CONTROLLING OUTPUT POWER SEQUENCE AND LIQUID CRYSTAL DISPLAY USING SAME

FIELD OF THE INVENTION

The present invention relates to power control circuits such as those used in liquid crystal displays (LCDs), and more particularly to a power control circuit configured for controlling power sequence of gate drivers of an LCD. The present invention also relates to an LCD employing the power control circuit.

GENERAL BACKGROUND

A typical LCD has the advantages of portability, low power consumption, and low radiation. Therefore the LCD has been widely used in various portable information products, such as notebooks, personal digital assistants (PDAs), video cameras, and the like.

The LCD typically includes gate drivers for outputting gate signals to control switch elements of a liquid crystal display panel. For example, when the gate signals are high-level voltage signals, the switch elements of the liquid crystal display panel are turned on. When the gate signals are low-level voltage signals, the switch elements of the liquid crystal display panel are turned off. Thus the LCD needs a power control circuit for providing a power voltage, a high-level voltage, and a low-level voltage to enable the gate drivers to function.

Typically, time delays of electronic elements of the power control circuit are different, yet the power voltage, the high-level voltage, and the low-level voltage are in effect almost simultaneously applied to the gate drivers. As a result, the functioning of electronic elements (not shown) in the gate drivers is uncertain. That is, the gate drivers may operate improperly. When this happens, the LCD employing the power control circuit may display images incorrectly.

What is needed, therefore, is a power control circuit that can overcome the above-described deficiencies, and an LCD employing the power control circuit.

SUMMARY

A power control circuit includes a scaler circuit configured for outputting a control signal, a voltage converter configured for converting a received voltage into a plurality of desired voltages, a first control unit, a second control unit, and a coupling circuit. The first control unit is configured for controlling whether a first voltage is applied to the voltage converter. The second control unit is configured for controlling whether to transmit a second voltage applied thereto. The coupling circuit is between the first and second control units. The coupling circuit enables the second control unit to function ahead of the voltage converter according to the control signal.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments in detail.

Figure 1:
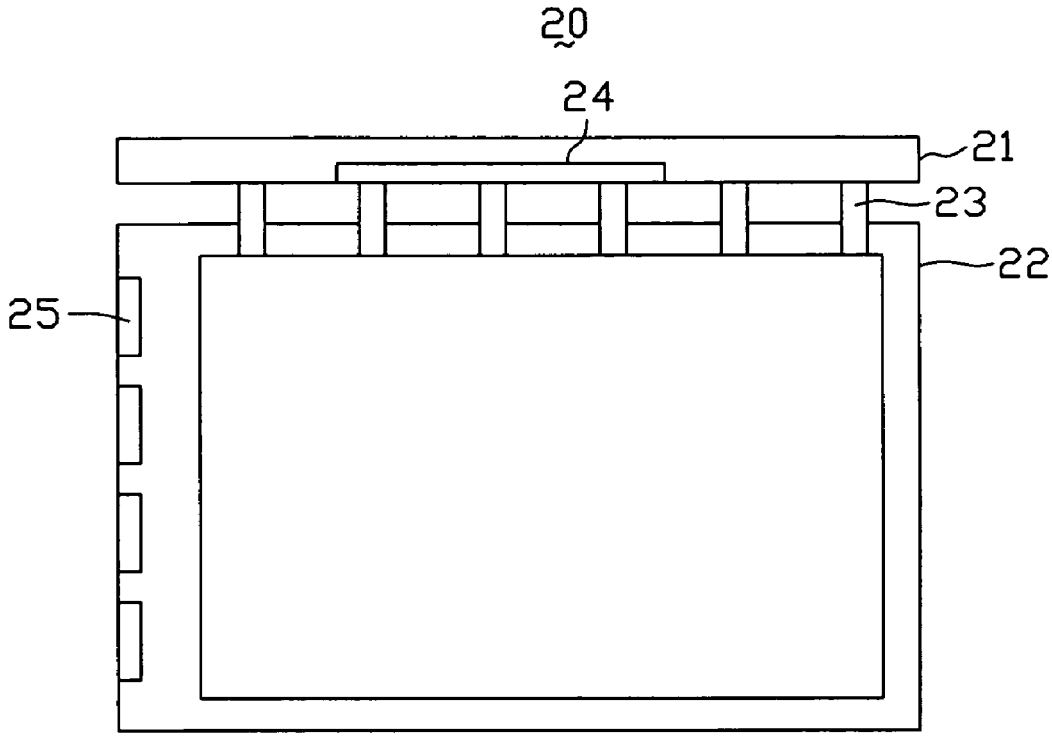
FIG. 1 is a schematic plan view of certain components of a liquid crystal display according to an exemplary embodiment of the present invention, the liquid crystal display including a power control circuit.

FIG. 1 is a schematic diagram of certain components of an LCD according to an exemplary embodiment of the present invention. The LCD 20 includes a printed circuit board (PCB) 21, a liquid crystal display panel 22, a number of flexible printed circuit boards (FPCBs) 23. The liquid crystal display panel 22 is connected to the PCB 21 via the FPCBs 23.

The liquid crystal display panel 22 includes a number of gate drivers 25 for driving gate lines (not shown) of the liquid crystal display panel 22. The PCB 21 includes a power control circuit 24 for controlling power sequence of the gate drivers 25.

Figure 2:
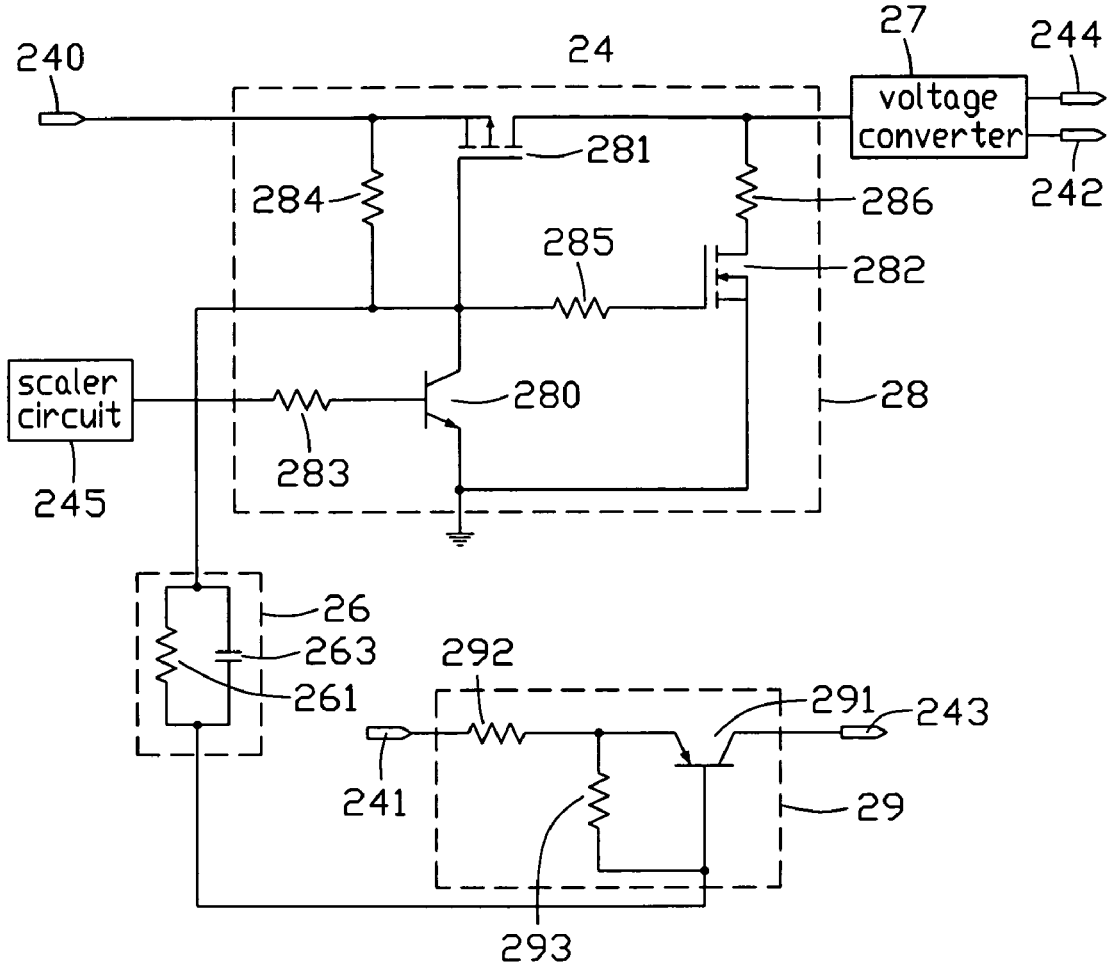
FIG. 2 is a circuit diagram of the power control circuit of FIG. 1.

Referring also to FIG. 2, this is a circuit diagram of the power control circuit 24. The power control circuit 24 includes a first input terminal 240, a second input terminal 241, a first output terminal 242, a second output terminal 244, a third output terminal 243, a scaler circuit 245, a coupling circuit 26, a voltage converter 27, a first control unit 28, and a second control unit 29. The coupling circuit 26 includes a coupling resistor 261 and a coupling capacitor 263. The coupling resistor 261 and the coupling capacitor 263 are connected in parallel.

The first control unit 28 is provided for controlling whether a voltage received from the first input terminal 240 is applied to the voltage converter 27 according to a controlling signal output by the scaler circuit 245. The second control unit 29 is provided for controlling whether a voltage received from the second input terminal 241 is applied to the third output terminal 243. The voltage converter 27 is provided for converting the voltage received from the first input terminal 240 into two desired voltages. The two voltages are respectively provided as the high-level and low-level voltages of gate signals output by the gate drivers 25. The voltage output by the third output terminal 243 is applied to the gate drivers 25 as a power voltage. In the present embodiment, the high-level and low-level voltages of the gate signals are respectively +27V and −6V. The power voltage of the gate drivers 25 is +3.3V.

The first control unit 28 generally includes a first transistor 280, a second transistor 281, and a third transistor 282. In the present embodiment, the first transistor 280 is a negative-positive-negative (NPN) bipolar junction transistor, the second transistor 281 is a P-channel enhancement-mode metal-oxide-semiconductor field-effect transistor (P-MOSFET), and the third transistor 282 is an N-channel enhancement-mode metal-oxide-semiconductor field-effect transistor (N-MOSFET). An output terminal (not labeled) of the scaler circuit 245 is connected to a base electrode (not labeled) of the first transistor 280 via a base bias resistor 283. An emitter electrode (not labeled) of the first transistor 280 is grounded. A collector electrode (not labeled) of the first transistor 280 is connected to a gate electrode (not labeled) of the second transistor 281.

A source electrode (not labeled) of the second transistor 281 is connected to the first input terminal 240. A drain electrode (not labeled) of the second transistor 281 is connected to an input terminal (not labeled) of the voltage converter 27. A first voltage-dividing resistor 284 is connected between the source and gate electrodes of the second transistor 281. A gate electrode (not labeled) of the third transistor 282 is connected to the gate electrode of the second transistor 281 via a gate resistor 285. A source electrode (not labeled) of the third transistor 282 is grounded. A drain electrode (not labeled) of the third transistor 282 is connected to the drain electrode of the second transistor 281 via a drain resistor 286. Two output terminals of the voltage converter 27 are respectively connected to the first and second output terminals 242, 244 of the power control circuit 24.

The second control unit 29 includes a fourth transistor 291, a second voltage-dividing resistor 292, and a third voltage-dividing resistor 293. In the present embodiment, the fourth transistor 291 is a positive-negative-positive (PNP) bipolar junction transistor. A base electrode (not labeled) of the fourth transistor 291 is connected to the gate electrode of the second transistor 281 via the coupling circuit 26. An emitter electrode (not labeled) of the fourth transistor 291 is connected to the second input terminal 241 of the power control circuit 24 via the second voltage-dividing resistor 292. A collector electrode (not labeled) of the fourth transistor 291 is connected to the third output terminal 243 of the power control circuit 24. The third voltage-dividing resistor 293 is connected between the emitter and base electrodes of the fourth transistor 291.

In operation, a +5V direct current voltage is applied to the first input terminal 240, and a +3.3V direct current voltage is applied to the second input terminal 241. Thereby, the first, second, and fourth transistors 280, 281, 291 are turned off and the third transistor 282 is turned on. The input terminal of the voltage converter 27 is grounded via the drain resistor 286 and the third transistor 282. As a result, the low-level voltage, the high level-voltage, and the power voltage cannot be applied to the gate drivers 25 via the first, second, and third output terminals 242, 244, 243.

In this instance, a voltage difference U1 applied to the two electrodes (not labeled) of the coupling capacitor 263 is expressed by the following equation:

$$U1 = \frac{(V1 - V2) * R2}{R1 + R2 + R3 + R4} \tag{1}$$

where V1, V2 respectively represent the direct current voltages applied to the first and second input terminals 240, 241; R1, R3, R4 respectively represent resistances of the first, second, and third voltage-dividing resistors 284, 292, 293; and R2 represents a resistance of the coupling resistor 261. In the present embodiment, because V1>V2, the voltage applied to one electrode of the coupling capacitor 263 connected to the gate electrode of the second transistor 281 is greater than that applied to the other electrode of the coupling capacitor 263 connected to the base electrode of the fourth transistor 291.

If the gate drivers 25 need power, the scaler circuit 245 outputs an enable signal to the base electrode of the first transistor 280 via the base bias resistor 283. Thereby, the first transistor 280 is turned on, and low-level voltages are applied to the gate electrodes of the second and third transistors 281, 282. As a result, the second transistor 281 is turned on and the third transistor 282 is turned off. The +5V direct current voltage is applied to the voltage converter 27, and is converted into +27V, −6V direct current voltages therein. The 27V, −6V direct current voltages are then respectively applied to each of the gate drivers 25 via the second and first output terminals 244, 242.

Moreover, once the first transistor 280 is turned on, the voltage applied to the electrode of the coupling capacitor 263 connected to the gate electrode of the second transistor 281 is 0V. In this instance, according to the principle of charge conservation, the voltage difference between the two electrodes of the coupling capacitor 263 is maintained as U1. That is, the voltage U2 applied to the base electrode of the fourth transistor 291 is expressed by the following equation:

$$U2 = -\left(\frac{(V1 - V2) * R2}{R1 + R2 + R3 + R4}\right) \tag{2}$$

As a result, the voltage difference U3 between the emitter and base electrodes of the fourth transistor 291 is expressed by the following equation:

$$U3 = -\left(\frac{(V1 - V2) * R2}{R1 + R2 + R3 + R4} + V2\right) * \frac{R4}{R3 + R4} \tag{3}$$

In contrast, consider a voltage difference U4 between the emitter and base electrodes of the fourth transistor 291 in the case where there is no coupling circuit 26. U4 is expressed by the following equation:

$$U4 = -V2 * \frac{R4}{R3 + R4} \tag{4}$$

Compared to such voltage difference U4, the voltage difference U3 is increased. That is, a larger electrical current flows through the base electrode of the fourth transistor 291 so as to turn on the fourth transistor 291 more quickly. Thereby, the third output terminal 243 provides power voltage to the gate drivers 25 ahead of the low-level and high-level voltages output by the first and the second output terminals 242, 244. Therefore, normal functioning of electronic elements (not shown) in the gate drivers 25 is ensured. As a result, the gate drivers 25 can operate normally, and the LCD 20 employing the gate drivers 25 can display images correctly.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size, and arrangement of parts within the principles of the invention to the full extent indicated by the broad general meaning of the terms in which the appended claims are expressed.

What is claimed is:

1. A power control circuit, comprising:

a scaler circuit configured for outputting a control signal;

a voltage converter configured for converting a received voltage into a plurality of desired voltages;

a first control unit configured for controlling whether a first voltage is applied to the voltage converter according to the control signal;

a second control unit configured for controlling whether to transmit a second voltage applied to the second control unit; and a coupling circuit connected in series between the first and second control units, the coupling circuit enabling the second control unit to function ahead of the voltage converter according to the control signal wherein the first control unit comprises a first transistor, the first transistor comprises a source electrode capable of receiving the first voltage, a drain electrode connected to the voltage converter, and a gate electrode coupled to the coupling circuit; wherein the first control unit further comprises a third transistor, the third transistor comprises a base electrode connected to the scaler circuit, a emitter electrode that is grounded, and a collector electrode connected to the gate electrode of the first transistor; wherein the first control unit further comprises a fourth transistor, the fourth transistor comprises a gate electrode connected to the gate electrode of the first transistor via a resistor, a source electrode being grounded, and a drain electrode connected to the drain electrode of the first transistor via another resistor.

2. The power control circuit of claim 1, wherein the coupling circuit comprises a coupling resistor and a coupling capacitor connected in parallel, the first control unit connected to the second control unit via the coupling resistor and the coupling capacitor respectively.

3. The power control circuit of claim 2, wherein the second control unit comprises a second transistor, the second transistor comprises a emitter electrode for receiving the second voltage, a collector electrode for outputting the second voltage, and a base electrode connected to the coupling circuit.

4. The power control circuit of claim 3, wherein the second control unit comprises a second resistor connected between the emitter and base electrodes of the second transistor.

5. The power control circuit of claim 3, wherein the base electrode of the second transistor is connected to the gate electrode of the first transistor via the coupling resistor and the coupling capacitor.

6. The power control circuit of claim 1, wherein the first control unit further comprises a first resistor connected between the source and gate electrodes of the first transistor.

7. A power control circuit, comprising:

a scaler circuit configured for outputting a control signal;

a voltage converter configured for converting a received voltage into a plurality of desired voltages;

a first control unit configured for controlling whether a first voltage is applied to the voltage converter according to the control signal;

a second control unit configured for controlling whether to transmit a second voltage applied to the second control unit; and a coupling circuit connected in series between the first and second control units, the second control unit receiving the control signal via the coupling circuit, and the coupling circuit enabling the second control unit to function ahead of the voltage converter according to the control signal.

8. The power control circuit of claim 7, wherein the first control unit comprises a first transistor, the first transistor comprises a source electrode capable of receiving the first voltage, a drain electrode connected to the voltage converter, and a gate electrode coupled to the coupling circuit.

9. The power control circuit of claim 8, wherein the first control unit further comprises a resistor connected between the source and gate electrodes of the first transistor.

10. The power control circuit of claim 8, wherein the second control unit comprises a second transistor, the second transistor comprises a emitter electrode for receiving the second voltage, a collector electrode for outputting the second voltage, and a base electrode connected to the first control unit via the coupling circuit.

11. The power control circuit of claim 10, wherein the second control unit comprises a second resistor connected between the emitter and base electrodes of the second transistor.

12. The power control circuit of claim 10, wherein the first control unit further comprises a third transistor, the third transistor comprises a base electrode connected to the scaler circuit, a emitter electrode that is grounded, and a collector electrode connected to the gate electrode of the first transistor.

13. The power control circuit of claim 12, wherein the first control unit further comprises a fourth transistor, the fourth transistor comprises a gate electrode connected to the gate electrode of the first transistor via a first resistor, a source electrode being grounded, and a drain electrode connected to the drain electrode of the first transistor via a second resistor.

14. The power control circuit of claim 10, wherein the coupling circuit comprises a coupling resistor and a coupling capacitor connected in parallel, the base electrode of the second transistor is connected to the gate electrode of the first transistor via the coupling resistor and the coupling capacitor respectively.

15. The power control circuit of claim 7, wherein the coupling circuit comprises a coupling resistor and a coupling capacitor connected in parallel, the first control unit connected to the second control unit via the coupling resistor and the coupling capacitor respectively.

16. The power control circuit of claim 15, the first control unit comprises a first transistor, the first transistor comprises a source electrode capable of receiving the first voltage, a drain electrode connected to the voltage converter, and a gate electrode coupled to the gate electrode of the second transistor via the coupling resistor and the coupling capacitor respectively.

17. The power control circuit of claim 16, wherein the second control unit comprises a second transistor, the second transistor comprises a emitter electrode for receiving the second voltage, a collector electrode for outputting the second voltage, and a base electrode connected to the first control unit via the coupling resistor and the coupling capacitor respectively.

18. The power control circuit of claim 17, wherein the second control unit comprises a resistor connected between the emitter and base electrodes of the second transistor.

19. The power control circuit of claim 17, wherein the first control unit further comprises a third transistor, the third transistor comprises a base electrode connected to the scaler circuit, a emitter electrode that is grounded, and a collector electrode connected to the gate electrode of the first transistor.

20. The power control circuit of claim 19, wherein the first control unit further comprises a fourth transistor, the fourth transistor comprises a gate electrode connected to the gate electrode of the first transistor via a first resistor, a source electrode being grounded, and a drain electrode connected to the drain electrode of the first transistor via a second resistor.

* * * * *